US005104285A

United States Patent [19]

Groenendaal, Jr. et al.

[11] Patent Number: 5,104,285

[45] Date of Patent: Apr. 14, 1992

[54] LOW PRESSURE INLET RING SUBASSEMBLY WITH INTEGRAL STAYBARS

[75] Inventors: John C. Groenendaal, Jr.; Robert C. Wynn, both of Winter Springs, Fla.

[73] Assignee: Westinghouse Electric Corp., Pittsburgh, Pa.

[21] Appl. No.: 600,059

[22] Filed: Oct. 18, 1990

[51] Int. Cl.[5] ..... F01D 3/02

[52] U.S. Cl. ..... 415/108; 415/93

[58] Field of Search ..... 415/108, 93, 214.1, 415/915, 98, 99

[56] References Cited

U.S. PATENT DOCUMENTS

| | | | |
|---|---|---|---|
| 4,029,432 | 6/1977 | Meylan et al. | 415/108 |
| 4,232,993 | 11/1980 | Ikeda | 415/177 |
| 4,863,341 | 9/1989 | Groenendaal | 415/177 |
| 4,915,581 | 4/1990 | Groenendaal, Jr. et al. | 415/108 |

FOREIGN PATENT DOCUMENTS

| | | | |
|---|---|---|---|
| 657860 | 9/1951 | United Kingdom | 415/108 |

*Primary Examiner*—John T. Kwon

[57] ABSTRACT

Integral cast inlet ring sections for low pressure steam turbines are disclosed. Preferably, semicircular inlet ring sections from opposing sides of the steam inlet are joined together by integral staybars to form an inlet ring subassembly. After fabrication into a turbine inner cylinder, the two inlet ring subassemblies are preferably joined by a horizontal joint, such as a bolted connection, to form a circular inlet ring. The present invention eliminates welds and other connections typically associated with staybars and thereby eliminates a source of stress concentration and fatigue failures in steam turbines. The present invention also permits the inlet ring to be welded to a flange in a manner which eliminates potential delamination of the flange by fusing the sites of potential delamination.

9 Claims, 3 Drawing Sheets

LOW PRESSURE INLET RING SUBASSEMBLY WITH INTEGRAL STAYBARS

FIELD OF THE INVENTION

The present invention relates to the field of turbines, and more particularly, to the structure of steam turbines in the inlet area for eliminating structural failures caused by welded inlet ring staybars.

BACKGROUND OF THE INVENTION

Low pressure steam turbines typically utilize a central inlet portion through which steam is initially passed and divided between sets of turbine blades. Referring to FIG. 1 a typical prior art low-pressure steam turbine 10 is shown. Steam from a source (not shown) is provided to the turbine 10 through a conduit 12 which passes through the outer casing 14, and attaches to the inner casing 16. Steam passes through an opening in the outer casing 14, through an opening in an inner casing 16, and then to an inlet chamber 18, which is formed within the inner casing 16. A rotor 20 is mounted by a bearing 22 at each end; the rotor 20 rotates about an axis of rotation "A." Annular rows of blades 24 are disposed along the rotor 20. A number of stationary annular rows of blades 26 are operatively positioned in relation to the rotor blades 24 for directing steam to the rotor blades 24. The stationary blades 26 are positioned through their attachment to various blade rings, which in turn are attached to the walls 30 of the inner casing 16. Inlet blade ring sections **29*a*,29*b* are positioned such that an opening 31 is formed therebetween for the passage of the flow of steam. The inlet blade ring sections 29*a*,29*b* are disposed so as to circumferentially surround the blades nearest the inlet. The inner casing 16 is aligned to outer casing 14 by fitted dowel assemblies 32**.

The inlet chamber 18 is shown to include sidewalls 34 which are oriented at an angle to the axis of rotation "A." Sidewalls 34 are attached at one end to the walls 30 and at the other end to the inlet ring sections **29*a*,29*b*. A number of staybars 36, of which only one is shown, are provided between the inlet ring sections 29*a*,29*b* in order to join each pair of inlet ring sections 29*a*,29*b*. been used. The inlet ring sections 29*a*,29*b* were either comprised of rolled steel half-rings to which the staybars 36 were welded, or the inlet ring sections 29*a*,29*b* were cast assemblies with integral bosses to which the staybars 36 were welded. Finally, a number of ribs 38*a*,38*b* are positioned within the inner casing 16 about the rotor 20, such that the ends of each rib 38 is in contact with the walls 30 and the inlet ring sections 29*a*,29*b***.

In operation, steam is supplied to the turbine 10 through the conduit 12, passing through the outer and inner casings 14,16 to the inlet chamber 18. Inlet chamber 18 directs the flow of steam to the midpoint of the rotor 20 where the steam expands axially through alternating annular rows of stationary blades 26 and rotational blades 24 thereby causing rotation. After crossing the last row of blades, the flow of steam is directed through an exhaust 39 and exits the turbine 10.

As explained above, the inlet ring sections **29*a*,29*b* are typically joined by staybars 36**. In most constructions, the rings themselves are split half-rings or semicircular sections which are joined by staybars to form inlet ring subassemblies. As known to those of ordinary skill in the art, the inlet ring subassemblies are typically joined by a horizontal joint. In a case where the inlet ring sections are rolled from pressure vessel steel plate, the cross-section is rectangular. This type of design creates an obstruction in the steam path that disturbs the flow. Moreover, the staybars themselves are welded to the rings which are in turn welded to the inner cylinder assembly. These extensive welds provide numerous stress concentration sites and frequently result in fatigue failure. Also, the plate from which the ring is formed could delaminate when it is rolled into an inlet ring section or during the welding operations, thereby causing a decrease in the material strength and necessitating repair. This type of failure is known as "laminar tearing." On the other hand, in the case of cast inlet ring sections, a desirable triangular cross-section may be obtained which better directs the steam flow. Cast inlet ring sections, however, also have integral cast bosses, which provide attachment locations for the staybars. The pairs of inlet ring sections are therefore still joined axially to form inlet ring subassemblies by welded-in staybars, typically of cylindrical cross-section. These staybars require extensive weld preparations and massive welds in order to hold them in place. The welds present exposed, irregular surfaces that produce fatigue-prone sites due to the high stress concentrations created.

It is therefore an object of the present invention to eliminate the weld preparation and welds related to the joining of cast inlet ring sections into inlet ring subassemblies which are prone to fatigue-induced failure.

It is a further object of the present invention to eliminate the use of rolled steel inlet ring sections and the welds used therein, thereby eliminating laminar tearing and other delamination failures in the inlet ring sections.

SUMMARY OF THE INVENTION

Accordingly, it has now been found that a low pressure steam turbine comprising an inlet for pressurized steam and at least at least one pair of blade assemblies each comprising a plurality of radially extending blades, disposed on opposite sides of the inlet may be constructed having at least one integral inlet ring subassembly. Preferably, the inlet ring subassembly comprises at least two inlet ring sections each circumferentially surrounding a portion of one of the pair of blade assemblies and affixed together by integral staybars extending axially from the inlet ring sections.

In a preferred embodiment, each inlet ring section comprises about one-half the circumference of the inlet ring and thereby forms a semicircular inlet ring subassembly. Thus, two of the semicircular subassemblies may be preferably joined by a horizontal joint. The horizontal joint may preferably comprise an integral portion formed in each of the semicircular subassemblies and at least one means for fastening the semicircular subassemblies together, such as a bolted connection. In certain embodiments, the inlet ring section may further comprise integral bosses from which the staybars extend. Preferably, the integral assembly provided by the present invention is attached to a flange structure such that any potential flange structure lamination is fused together by the weld which affixes the inlet ring subassembly to the turbine housing.

DETAILED DESCRIPTION OF THE PREFERRED EMBODIMENT

Figure 3:
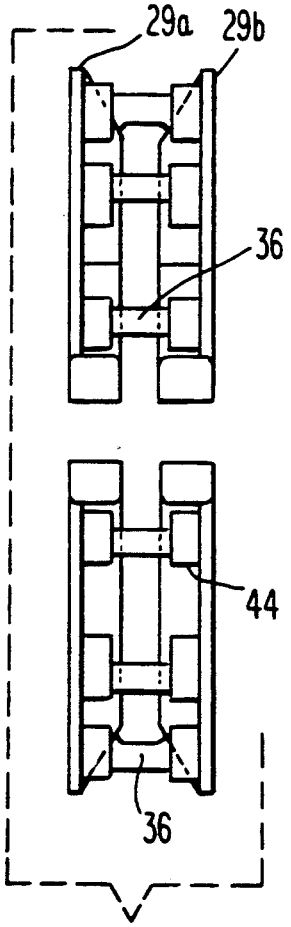
FIG. 3 is a side elevational view of the subassemblies depicted in FIG. 2.

As explained above in reference to FIG. 1, an inlet ring subassembly 29a,29b is typically been comprised of semicircular sections axially joined together by a series of staybars 36. Referring now to FIGS. 2-3, two cast, integral inlet ring subassemblies 46,48 made in accordance with the present invention are shown. These inlet ring subassemblies 46,48 are joined to from a circular inlet ring. As explained above, each pair of opposing semicircular inlet blade ring sections, e.g., 29a,29b are joined by staybars 36. In accordance with the present invention, the staybars 36, however, are cast as an integral structure with the inlet ring sections 29a,29b and preferably extend from bosses 44 which are also integrally formed with the semicircular inlet ring sections 29a,29b. When the complete turbine inner cylinder is fabricated, each subassembly 46,48 is joined by a horizontal joint 40 to form a complete ring assembly. As shown in FIG. 2, the horizontal joint 40 may be formed by a bolted connection 42. As readily understood by those of ordinary skill, the semicircular blade ring sections 29a,29b may otherwise be joined upon assembly into a turbine inner cylinder at the horizontal joint 40 by any of the many techniques of fastening appropriate for this type of a structure. Also, in certain embodiments it may be desirable to provide different connections upon different sides of the assembly or utilize other types of fasteners then the bolted connection 42 shown in FIG. 2. Moreover, the blade ring sections 29a,29b may be split into more than two subassemblies or split into subassemblies which comprise unequal portions of the circumference of the overall assembly.

Figure 1:
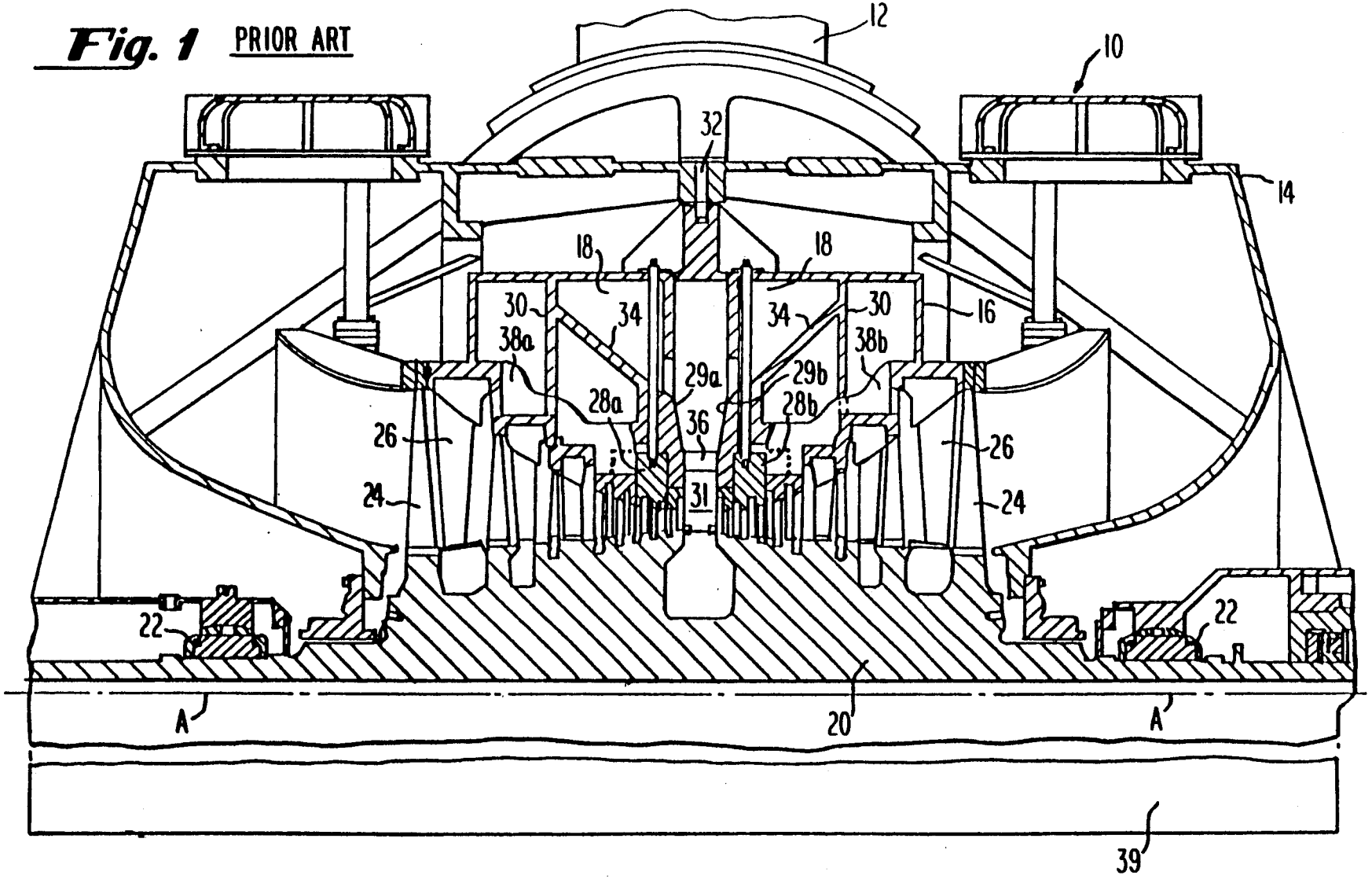
Fig. 1 PRIOR ART
FIG. 1 is a partial cross-sectional view of a typical low pressure steam turbine having components as utilized in the prior art.
Figure 2:
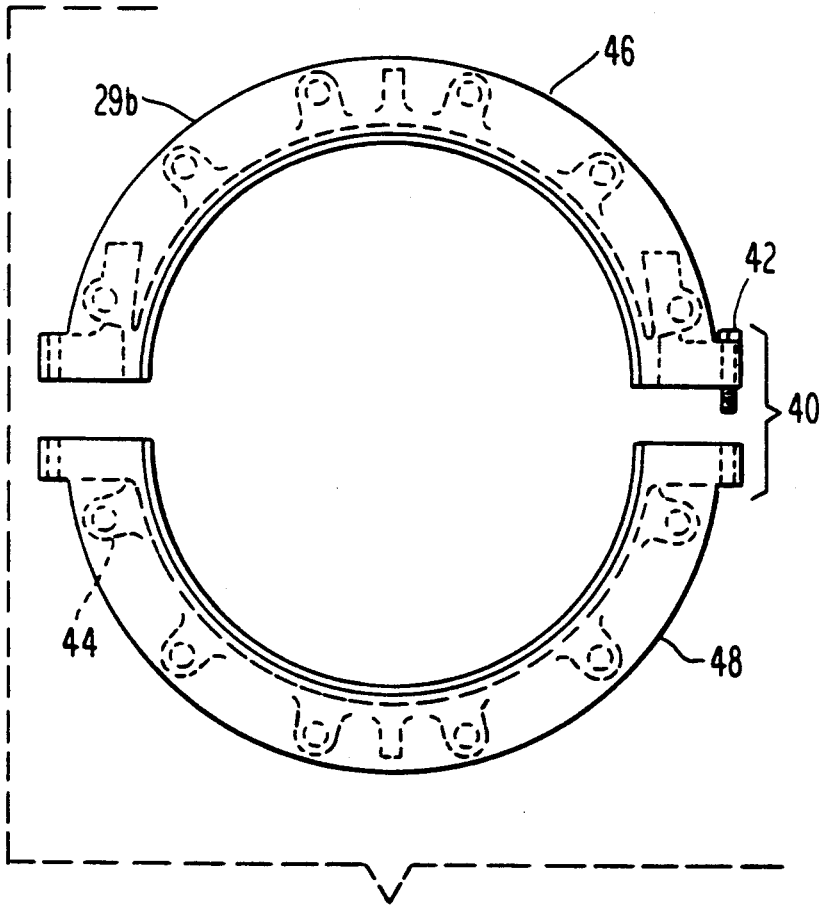
FIG. 2 is a front elevational view of two cast inlet ring subassemblies made in accordance with the present invention.
Figure 4:
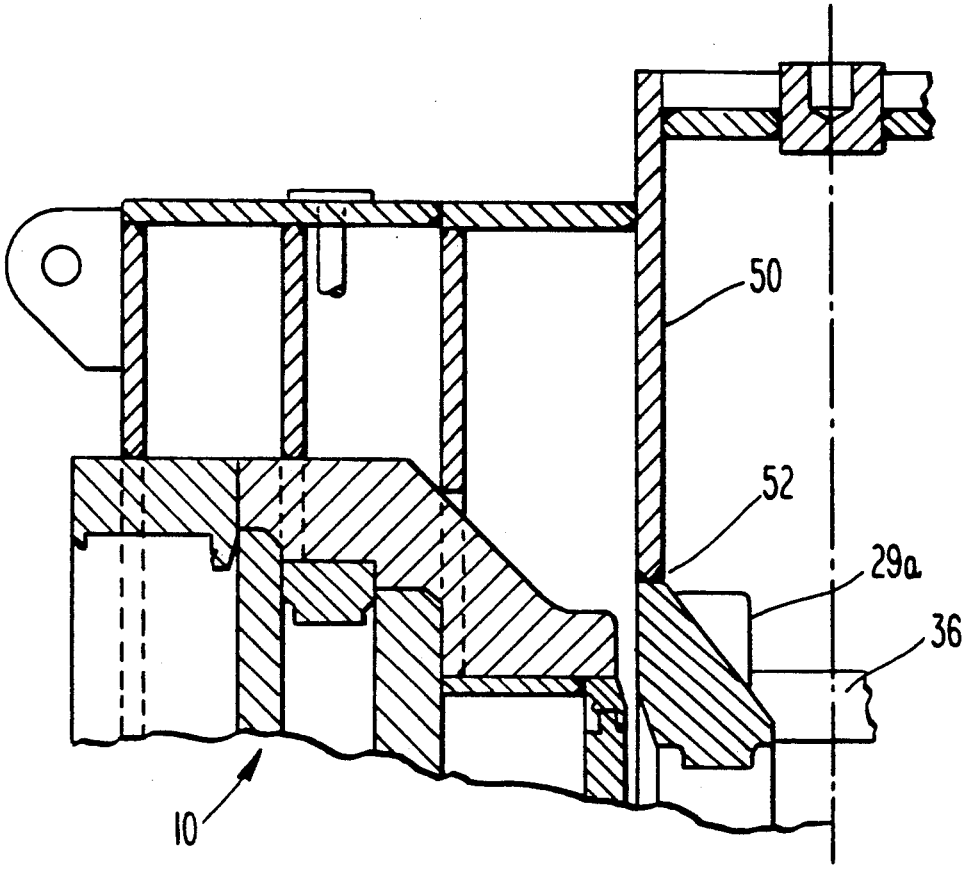
FIG. 4 is a broken away cross-sectional view of the inlet ring subassembly of the present invention installed in an inner cylinder.

Referring now to FIG. 4, there is shown a broken away section of a turbine assembly 10 similar to that depicted in FIG. 1 which incorporates the inlet ring subassemblies 46,48 of the present invention. The left edge of the upper inlet blade ring section 29a can be seen, along with a portion of one of the staybars 36. Also visible is the inlet chamber wall 50 to which the inlet blade ring is typically affixed. The inlet chamber wall 50 is welded directly to the inlet blade ring section 29a via welds 52.

Figure 5A:
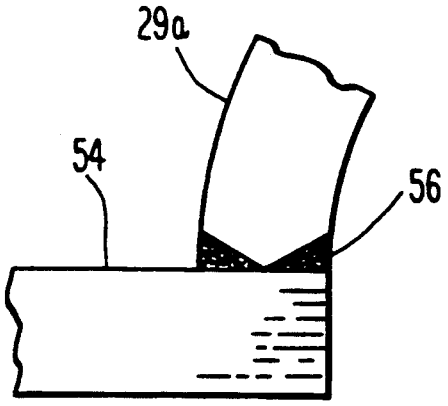
PRIOR ART Fig. 5A
FIG. 5A depicts the weld joint utilized in the prior art to join the inlet ring subassembly and flange to the turbine assembly.
Figure 5B:
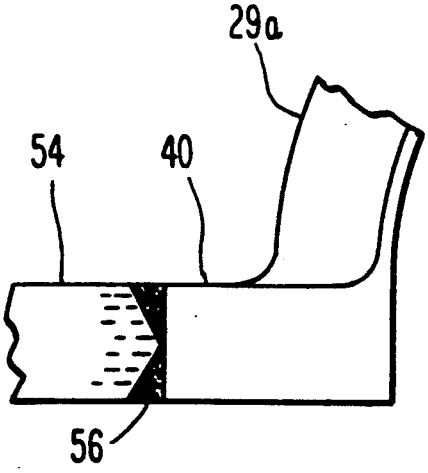
FIG. 5B depicts the weld joint formed to attach an integral inlet subassembly and flange to the turbine assembly made in accordance with the present invention.

FIG. 5A illustrates a broken away portion of a structure similar to that depicted in FIG. 2 which is installed in a typical manner found in the prior art, wherein the inlet ring 29a was affixed to the lateral surface a the flange 40 by the weld 56 as shown. As illustrated by the irregularly broken lines indicating potential lamination sites in the flange 40, one of ordinary skill will understand that the residual stresses developed in the structure from welding will tend to delaminate the flange 40. A similar situation exists in the prior art at the inlet wall 50 similar to that shown in FIG. 4. The prior art structure is welded to the inlet ring which is typically comprised of a rolled ring. In this case potential delamination sites existed near the ring outer diameter. As shown in FIG. 5B, using the integral construction of the present invention, it is now possible to place the weld 56 as depicted in FIG. 5B to result in the inlet ring section 29a abutting the end of the flange 40 so they are fused together. Also, the weld 52 shown in FIG. 4 may now also placed so as to fuse the laminations together, rather than place them in a condition to be delaminated, as discussed above. Thus, the present invention not only eliminates stresses and fatigue failures in the inlet ring structure itself, but also permits the design of the inlet ring structure to be more readily integrated into a steam turbine assembly in a manner which substantially reduces or eliminates failures in the flange 54 and other portions of the turbine assembly.

Integral inlet ring subassemblies 46,48 made in accordance with the present invention thus improve the design of cast inlet ring sections 29a,29b by providing integral staybars 36 in horizontal joint flanges 40. As shown in FIGS. 2-3, the design of the present invention preferably combines pairs of inlet ring sections 29a,29b into one integral subassembly having all the elements of existing inlet ring structures in a one piece, cast unit. The present invention provides a more reliable design by eliminating welds and thereby improving fatigue life. A significant reduction in stress concentration is achieved at the inlet ring and staybar juncture by the elimination of the welds and the provision of relatively large fillet radii at the junction. Also, it has been found that the present invention provides a structure capable of sustaining higher allowable stresses. This improved structural performance is in large measure caused by the elimination of heat-affected zones (HAZ's) in the inlet ring subassembly 46,48 and staybars 36. As explained above, reliability is also improved by eliminating the potential for laminar tearing at the weld between the flange 54 and inlet ring sections 29a,29b.

The overall reliability of steam turbines which incorporate the present invention is also improved by providing a shortened radial span of the inlet chamber walls 50 by using the integral inlet ring subassembly 46,48 of the present invention. As will be readily understood by those of ordinary skill, by shortening the radial span, the moment arm is reduced, thereby reducing pressure bending stresses. The present invention preferably overcomes failures associated with the porosity of castings used within steam turbines by utilizing stringent ultrasonic verification inspection techniques and the like, as well as by strictly controlling the conditions at the foundry. These safeguards reduce the porosity of the castings and therefore tend to eliminate failures to due porosity. Moreover, the above-described benefits achieved from utilizing a cast, integral assembly far outweigh the costs of improving the casting and inspection processes. The integral cast flanges 40 provided by the inlet ring subassemblies 46, 48 of the present invention also increase the integrity of bolted connections, and the integral reinforcing bosses 36 formed on the inlet ring sections 29a,29b distribute forces and moments to stabilize the structure in a more effective manner than previous designs. As a result, the overall assembly has a better stress distribution than any prior design.

In addition to increased reliability, the present invention also improves the efficiency of turbines into which it is installed. For example, the present invention improves the inlet steam flow by lowering the energy losses associated with the prior art welded ring designs since the obstructions formed by the square cross-section of the rings and staybars are eliminated, and the remaining obstructions are cast to provide streamlined flow guidance in the steam path. In addition to lowering the energy loss, the flow characteristics of the steam itself are improved by the cast design of the present invention which, in a manner similar to the improvement in stress distribution, improves the circumferential pressure and flow distributions within the turbine.

Finally, as will be readily appreciated by those of ordinary skill, the integral design of the present invention also eliminates the cost associated with welding the staybars in place. Typically, twenty-four or more costly welds per low pressure cylinder were required. These welds created heat-affected zones, stress concentrations, and otherwise reduced the reliability of the structure. As mentioned above, the present invention also shortens the radial span of the inlet wall, resulting in lower pressure bending stresses. It is therefore now possible to reduce the inlet wall plate thickness by between 10% and 20%. Moreover, from a fabrication standpoint, the design of the present invention may be readily cast by most foundries, making the overall fabrication costs of the completed assembly cost-effective. Similarly, since some low pressure steam turbines presently utilize the cast rings and welded staybars discussed above, the integral assembly of the present invention, although presenting a significantly improved design, also presents a design of proven reliability which may be retrofit into existing steam turbines if desired.

Although certain embodiments of the present invention have been described with a great deal of specificity, it will be understood that these examples are for purposes of illustration and not meant to be limiting. Those of ordinary skill will readily envision numerous modifications and adaptations of the present invention upon review of the disclosure set forth above without departing from the spirit of the present invention. Accordingly, reference should be made to the appended claims in order to determine the full scope of the present invention.

What is claimed is:

1. A low pressure steam turbine comprising an inlet for pressurized steam, at least one pair of blade assemblies each comprising a plurality of radially extending blades disposed on opposite sides of said inlet, and at least one integral, cast inlet ring subassembly comprising at least two inlet ring sections each circumferentially surrounding a portion of one of said pair of blade assemblies, said inlet ring sections affixed together in an integral, cast assembly by staybars extending axially from and connecting said inlet ring sections.

2. The steam turbine of claim 1, wherein each inlet ring section comprises about one-half the circumference of said inlet ring and thereby forms a semicircular inlet ring subassembly.

3. The steam turbine of claim 2, wherein two of said semicircular subassemblies are joined by a horizontal joint upon assembly into a steam turbine, said subassemblies comprising an integral portion formed in each of said semicircular inlet ring subassemblies and at least one means for fastening said semicircular subassemblies together.

4. The steam turbine of claim 3, wherein said means for fastening is a bolted connection.

5. The steam turbine of claim 1, wherein said inlet ring section further comprises integral bosses from which said staybars extend.

6. The steam turbine of claim 1, further comprising a flange structure affixed to said inlet ring section, whereby said flange structure is fused together at the sites of potential lamination.

7. An inlet ring disposed within a steam turbine so as to circumferentially surround at least a portion of each of two sets of steam turbine blades disposed on opposite sides of the steam inlet of the turbine, the inlet ring comprising at least two inlet ring sections connected by one or more stay bars, wherein the inlet ring sections and staybars are cast as an integral assembly.

8. The inlet ring of claim 7, wherein the inlet ring comprises at least two subassemblies, the subassemblies each comprising inlet ring sections and staybars cast as an integral assembly.

9. The inlet ring of claim 8, wherein each of the subassemblies comprises a semicircular section and further comprises a joint means for joining the subassemblies together.

* * * * *